US008113352B1

(12) United States Patent
Kao

(10) Patent No.: US 8,113,352 B1
(45) Date of Patent: Feb. 14, 2012

(54) STORAGE FRAME FOR TOOL RACK PACKAGES

(76) Inventor: Jui-Chien Kao, Taichung Hsien (TW)

( * ) Notice: Subject to any disclaimer, the term of this patent is extended or adjusted under 35 U.S.C. 154(b) by 2 days.

(21) Appl. No.: 12/858,762

(22) Filed: Aug. 18, 2010

(51) Int. Cl.
*B65D 85/62* (2006.01)

(52) U.S. Cl. ..... 206/775; 206/485; 211/59.4; 211/85

(58) Field of Classification Search ..... 206/740, 206/756, 765, 372, 775, 779, 485, 784, 587, 206/814; 211/49.1, 59.4, 126, 71.01, 85
See application file for complete search history.

(56) References Cited

U.S. PATENT DOCUMENTS 5,460,277 A * 10/1995 Silva ..... 211/71.01
5,878,884 A * 3/1999 Mayled ..... 206/455
6,386,376 B1 * 5/2002 Mendoza-Castillo et al. ..... 211/41.14
2006/0048486 A1 * 3/2006 Laing et al. ..... 53/469
* cited by examiner

*Primary Examiner* — Jacob K Ackun
(74) *Attorney, Agent, or Firm* — WPAT, P.C.; Anthony King

(57) ABSTRACT

A storage frame for tool rack packages has two side walls and a middle wall arranged between the side walls. Each side wall has two side bars and a side board connecting the side bars. Each side bar has multiple side mounts respectively corresponding to the side mounts of the other side bar. Each side mount has two side tabs and a side gap defined between the side tabs. The middle wall has two middle bars and a middle board connecting the middle bars. Each middle bar has multiple middle mounts respectively mounted on two side surfaces of the middle bar and respectively corresponding to the middle mounts of the other middle bar and respectively corresponding to the side mounts of the side bars. Each middle mount has two middle tabs and a middle gap defined between the middle tabs.

1 Claim, 8 Drawing Sheets

STORAGE FRAME FOR TOOL RACK PACKAGES

BACKGROUND OF THE INVENTION

1. Field of the Invention

The present invention relates to a frame, and more particularly to a storage frame for tool rack packages having two side walls and a middle wall to hold and display tool rack packages at a stand condition.

2. Description of the Prior Art

A tool rack package is used to package tool racks and has a board and two clamps. The tool racks are attached on the board and parallel to each other. The clamps are perpendicular to the tool racks, respectively clamp two ends of each tool rack and are mounted on the board to hold the tool racks regularly and stably on the board.

A conventional storage way for arranging the tool rack packages is lying the tool rack packages down and stacking them up. However, the tool rack packages are not easy to be arranged and stacked regularly because the tool racks are attached on the board and bulged from the board.

To overcome the shortcomings, the present invention provides a storage frame for tool rack packages to mitigate or obviate the aforementioned problems.

SUMMARY OF THE INVENTION

The main objective of the invention is to provide a storage frame for tool rack packages having two side walls and a middle wall to hold and display tool rack packages at a stand condition.

The storage frame for tool rack packages has two side walls and a middle wall arranged between the side walls. Each side wall has two side bars and a side board connecting the side bars. Each side bar has multiple side mounts respectively corresponding to the side mounts of the other side bar. Each side mount has two side tabs and a side gap defined between the side tabs. The middle wall has two middle bars and a middle board connecting the middle bars. Each middle bar has multiple middle mounts respectively mounted on two side surfaces of the middle bar and respectively corresponding to the middle mounts of the other middle bar and respectively corresponding to the side mounts of the side bars. Each middle mount has two middle tabs and a middle gap defined between the middle tabs.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
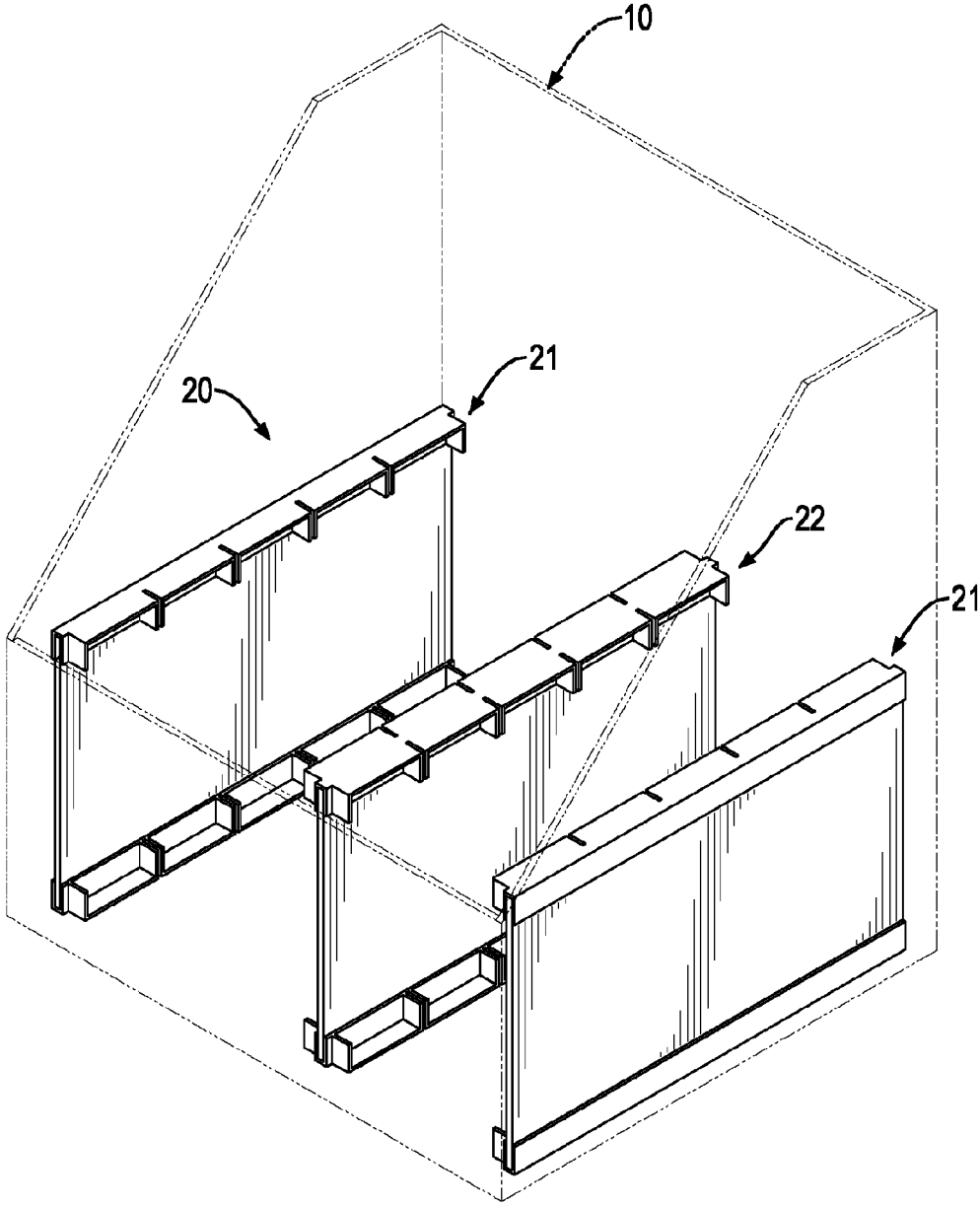
FIG. 1 is a perspective view of a storage frame for tool rack packages in accordance with the present invention.
Figure 2:
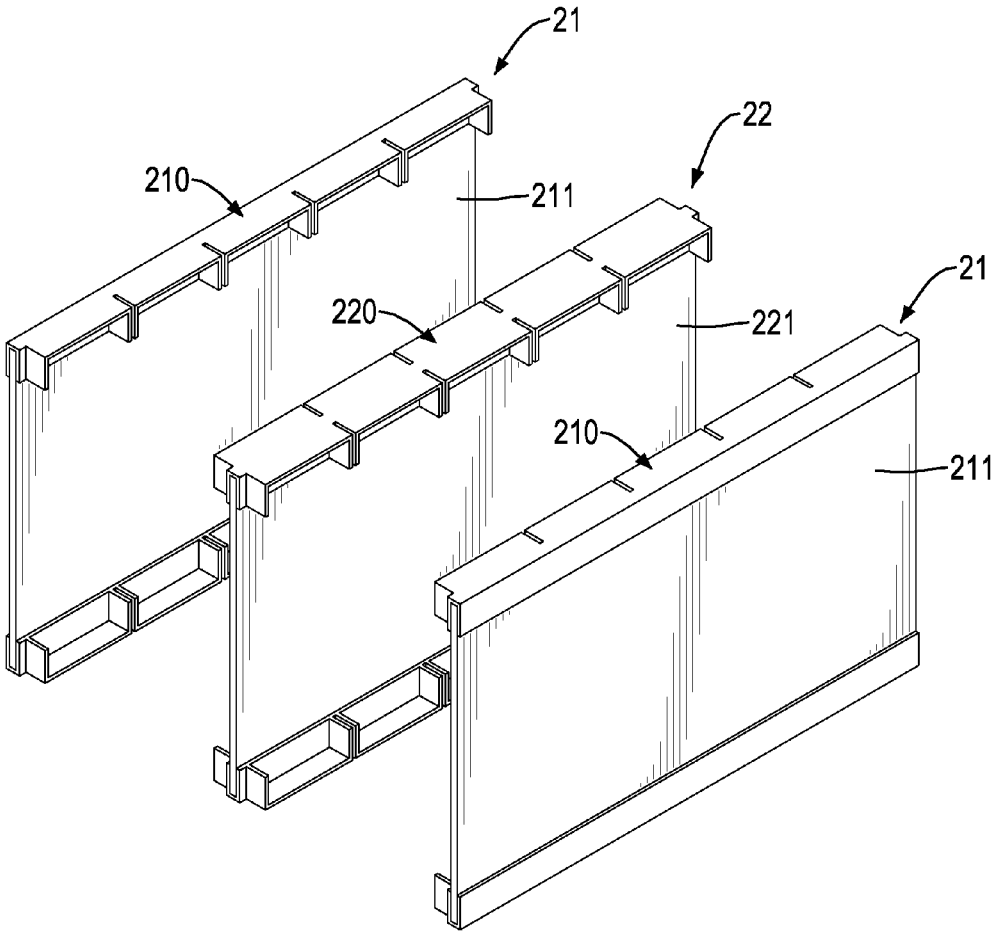
FIG. 2 is a partially perspective view of a frame of the storage frame for tool rack packages in FIG. 1.
Figure 3:
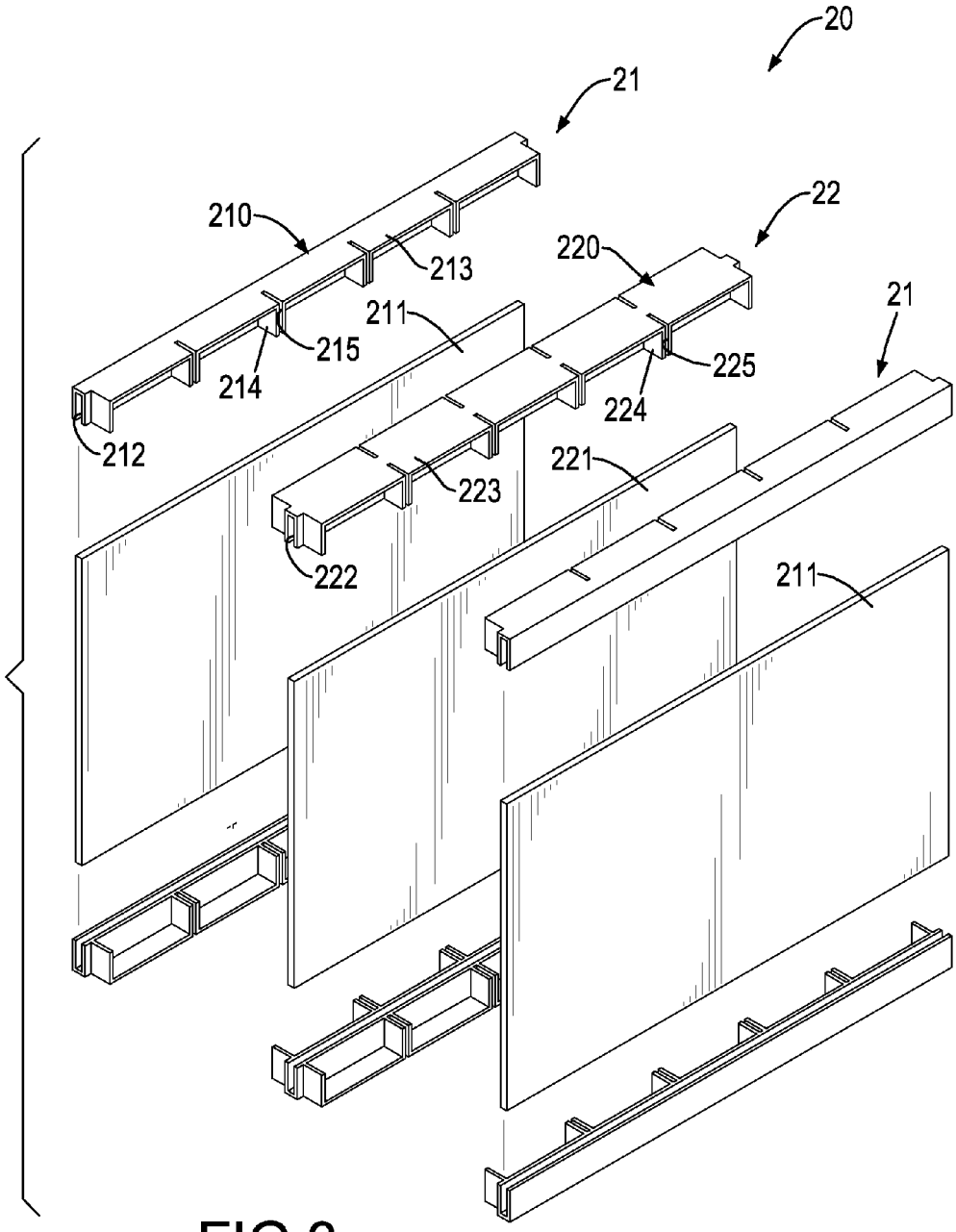
FIG. 3 is an exploded perspective view of the frame of the storage frame for tool rack packages in FIG. 2.
Figure 4:
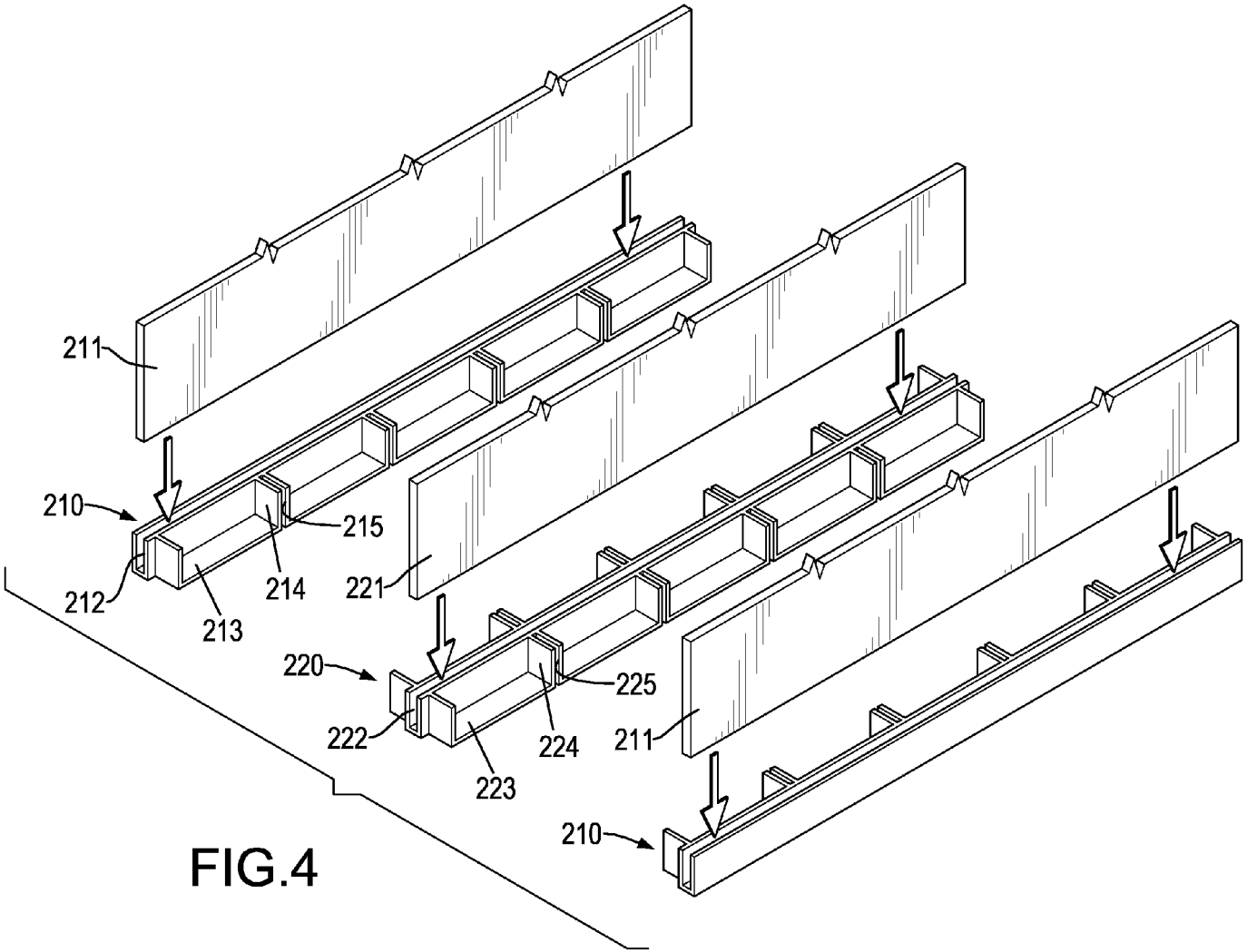
FIG. 4 is a partially exploded perspective view of the frame of the storage frame for tool rack packages in FIG. 2.
Figure 5:
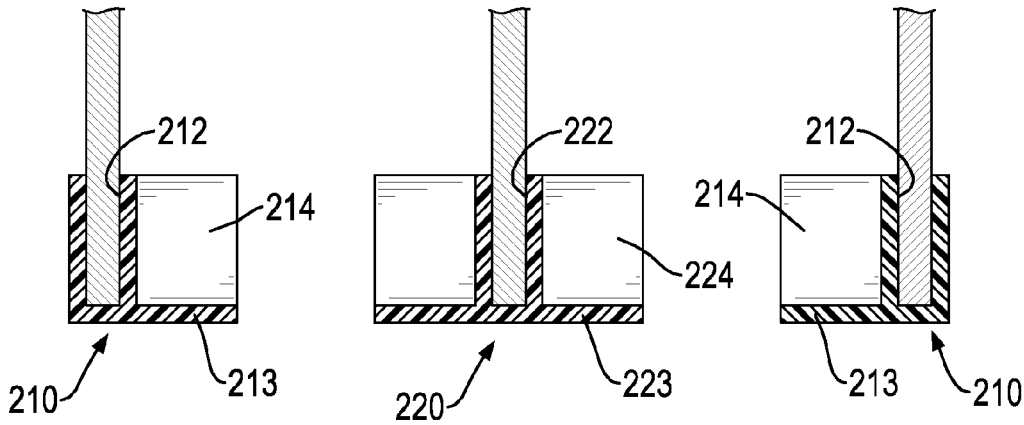
FIG. 5 is an enlarged view in partial cross section of the frame of the storage frame for tool rack packages in FIG. 4.
Figure 6:
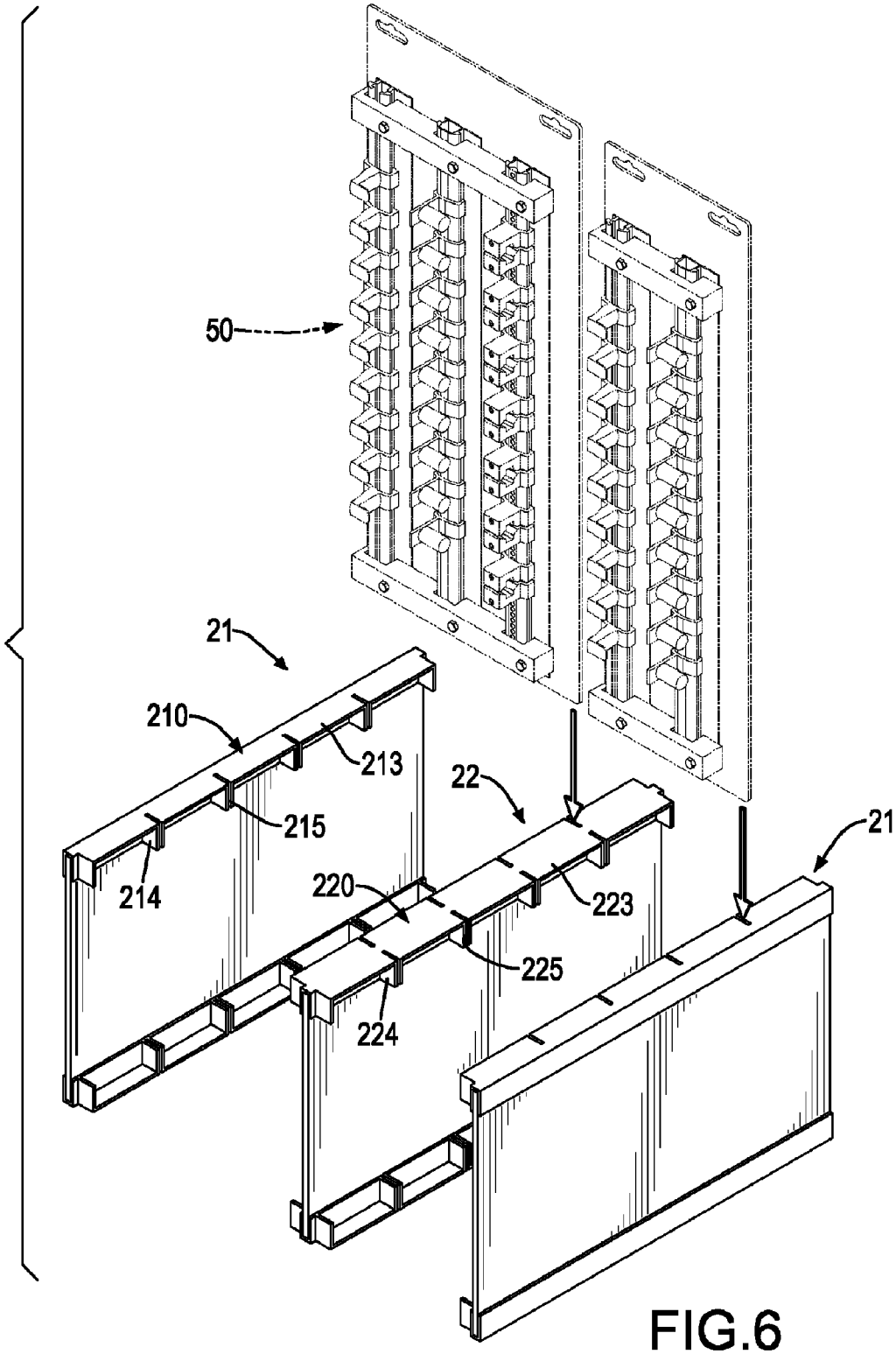
FIG. 6 is an operational perspective view of the frame of the storage frame for tool rack packages in FIG. 2 showing tool rack packages being inserted in the frame.

With reference to FIG. 1, a storage frame for tool rack packages in accordance with the present invention is used in containing tool rack packages at a stand condition and has a box 10 and a frame 20. The box 10 may be made of paper and has a containing space and an opening top.

With reference to FIGS. 2 to 5, the frame 20 is contained in the box 10 and has two side walls 21 and a middle wall 22. The side walls 21 are arranged parallelly to each other, and each side wall 21 has two side bars 210 and a side board 211. The two side bars 210 are arranged horizontally and parallel to each other, and each side bar 210 has a capping recess 212, multiple side mounts and multiple connecting tabs 213. The capping recess 212 is formed in the side bar 210 and faces to the capping recess 212 of the other side bar 210.

The side mounts are mounted on the side bar 210 and respectively correspond to the side mounts of the other side bar 210, and each side mount has two side tabs 214 and a side gap 215. The side tabs 214 are separately mounted on the side bar 210 and protrude toward the other side wall 21 to form the side gap 215 defined between the side tabs 214. The connecting tab 213 is mounted between and connected to two adjacent tabs 213 of adjacent and different side mounts. The side board 211 is mounted between and connected to the side bars 210 of the side wall 21 and has two edges held respectively in the capping recesses 212 of the side bars 210.

The middle wall 22 is arranged between and is parallel to the side walls 21 and has two middle bars 220 and a middle board 221. The two middle bars 220 are arranged horizontally and parallel to each other, and each middle bar 220 has a mounting recess 222, two side surfaces, multiple middle mounts and multiple linking tabs 223. The mounting recess 222 is formed in the middle bar 220 and faces to the mounting recess 222 of the other middle bar 220.

The side surfaces of the middle bar 22 respectively face to the side walls 21. The middle mounts are respectively mounted on the side surfaces of the middle bar 210 and respectively correspond to the middle mounts of the other middle bar 220 and respectively correspond to the side mounts of the side bars 210 of the side walls 21. Each side mount has two middle tabs 224 and a middle gap 225. The middle tabs 224 are separately mounted on the side surface of the middle bar 220 and protrude toward the side wall 21 to form the middle gap 225 between the middle tabs 224. The linking tab 223 is mounted between and connected to two adjacent middle tabs 223 of adjacent and different middle mounts. The middle board 221 is mounted between the middle bars 220 of the middle wall 22 and has two edges held respectively in the mounting recesses 222 of the middle bars 220.

Figure 7:
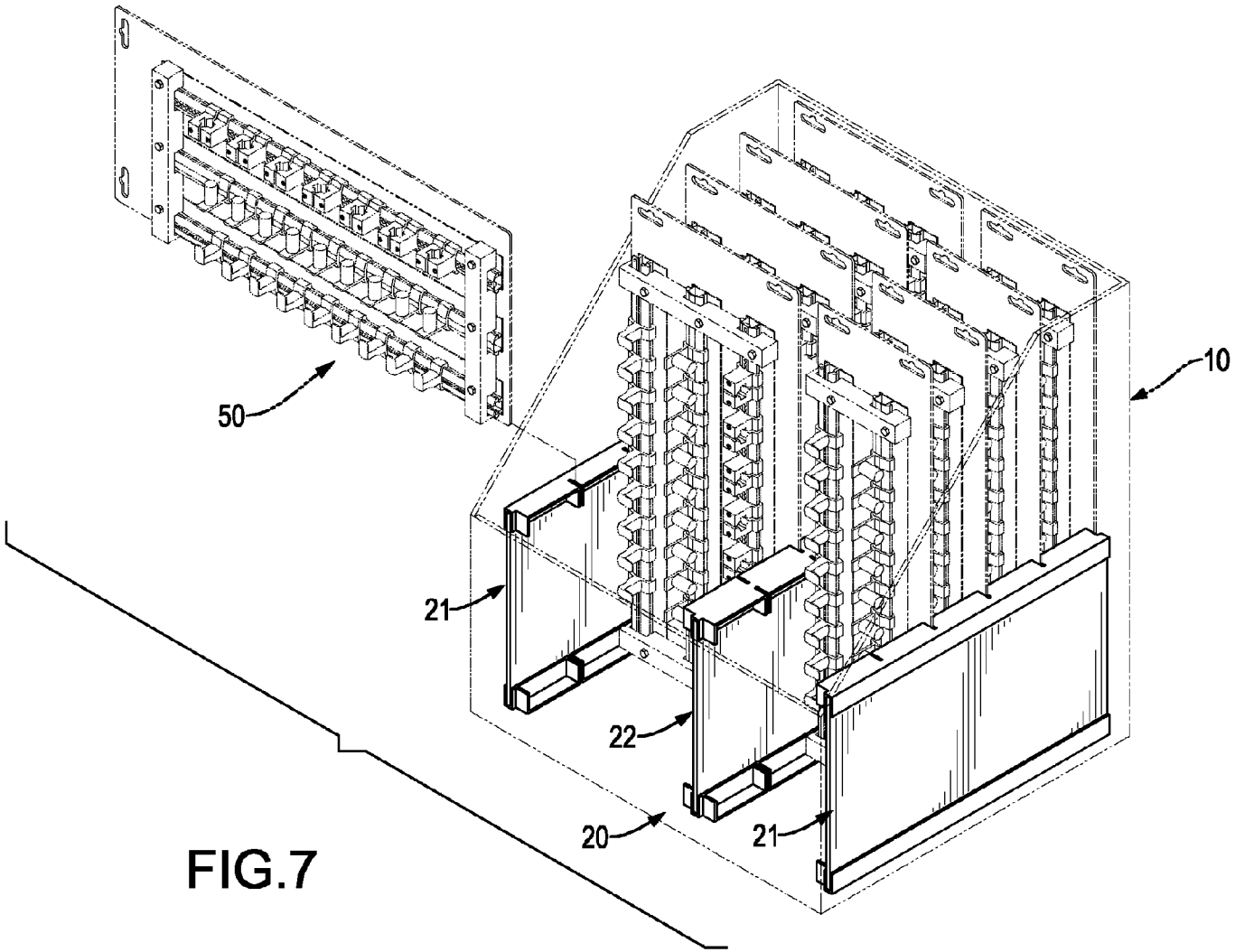
FIG. 7 is an exploded operational perspective view of the storage frame for tool rack packages in FIG. 1 showing the tool rack packages being inserted in the frame.
Figure 8:
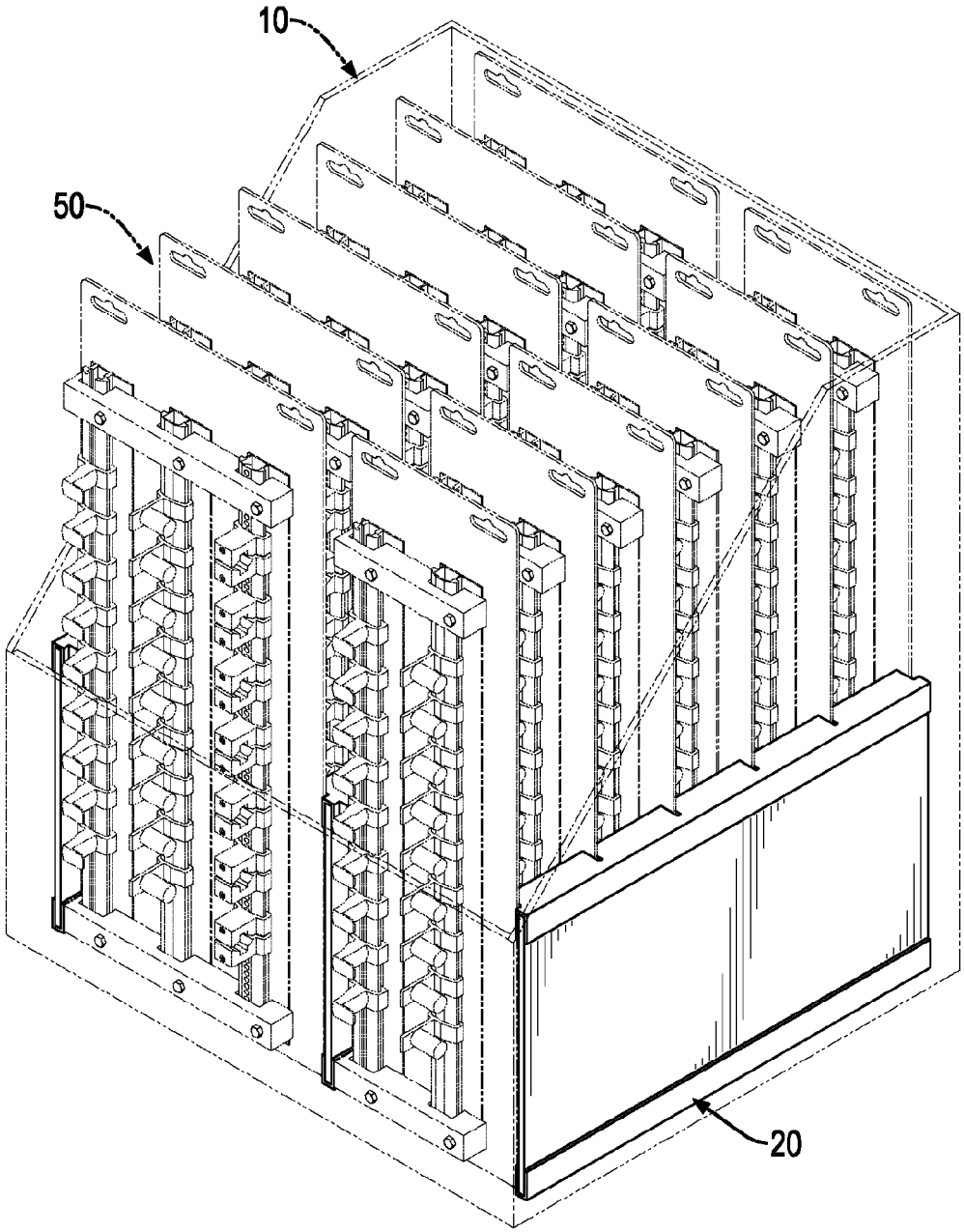
FIG. 8 is a perspective view of storage frame for tool rack packages in FIG. 1 showing the tool rack packages being inserted in the frame and arranged regularly.

With reference to FIGS. 7 and 8, when the storage frame is in use, multiple tool rack packages 50 are inserted between one of the side walls 21 and the middle wall 22 in the box 10 at a stand condition to arrange regularly, display clearly and save containing space. Each tool rack package 50 is inserted in the corresponding side mounts of the side bars 210 of the side wall 21 and the middle mounts of the middle bars 220 of the middle wall 22. Furthermore, each tool rack package 50 may have two parallel inserting edges and the inserting edges are inserted respectively in the corresponding side gap 215 of the side mounts and the middle gap 225 of the middle mounts and clamped by the side tabs 214 of the side mounts and the middle tabs 224 of the middle mount which are corresponding to each other. The connecting tabs 213 and the linking tabs 223 provide a fool-proof design to help the inserting edges of the tool rack package 50 being inserted in the gaps 215, 225 exactly.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A storage frame for tool rack packages comprising a frame having a two side walls arranged parallelly to each other and each side wall having two side bars arranged horizontally and parallel to each other, and each side bar having a capping recess formed in the side bar and facing to the other side bar;

multiple side mounts mounted on the side bar and respectively corresponding to the side mounts of the other side bar, and each side mount having two side tabs protruding toward the other side wall and a side gap defined between the side tabs; and multiple connecting tabs connecting two adjacent side tabs of adjacent and different side mounts;

a side board mounted between and connecting the side bars of the side wall by mounted in the capping recesses of the side bars; and a middle wall arranged between the side walls, being parallel to side walls and having two middle bars arranged horizontally and parallel to each other, and each middle bar having a mounting recess formed in the middle bar and facing to the other middle bar;

two side surfaces respectively facing to the side walls;

multiple middle mounts respectively mounted on the side surfaces of the middle bar and respectively corresponding to the middle mounts of the other middle bar and respectively corresponding to the side mounts of the side bars of the side walls, and each side mount having two middle tabs and a middle gap defined between the middle tabs; and multiple linking tabs connecting two adjacent middle tabs of the adjacent and different middle mounts; and a middle board mounted between and connecting the middle bars of the middle wall by mounted in the mounting recesses of the middle bars.

* * * * *